US008460016B2

(12) United States Patent
Liu

(10) Patent No.: US 8,460,016 B2
(45) Date of Patent: Jun. 11, 2013

(54) SOCKET AND POWER ADAPTER EMPLOYING SAME

(75) Inventor: Yu-Cheng Liu, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 0 days.

(21) Appl. No.: 13/308,558

(22) Filed: Dec. 1, 2011

(65) Prior Publication Data

US 2013/0109204 A1 May 2, 2013

(30) Foreign Application Priority Data

Oct. 31, 2011 (TW) ..... 100220503 A

(51) Int. Cl.
*H01R 9/09* (2006.01)

(52) U.S. Cl.
USPC ..... 439/106; 439/677

(58) Field of Classification Search
USPC ..... 439/106, 677, 679, 680
See application file for complete search history.

(56) References Cited

U.S. PATENT DOCUMENTS

| | | | | |
|---|---|---|---|---|
| 2,899,668 | A * | 8/1959 | Gribben | 439/115 |
| 5,342,221 | A * | 8/1994 | Peterson | 439/677 |
| 5,674,094 | A * | 10/1997 | Hutchinson et al. | 439/680 |
| 6,837,750 | B2 * | 1/2005 | Fukuda et al. | 439/680 |
| 6,851,960 | B2 * | 2/2005 | Bain et al. | 439/172 |
| 6,860,765 | B1 * | 3/2005 | Spink, Jr. | 439/680 |
| 6,893,274 | B2 * | 5/2005 | Chen et al. | 439/106 |
| 7,121,899 | B2 * | 10/2006 | Homann et al. | 439/680 |
| 7,201,612 | B1 * | 4/2007 | Hou | 439/680 |
| 7,300,302 | B2 * | 11/2007 | Kajiwara et al. | 439/485 |
| 7,927,108 | B2 * | 4/2011 | Gong et al. | 439/63 |
| 8,152,570 | B2 * | 4/2012 | Kim et al. | 439/680 |
| 2002/0070702 | A1 * | 6/2002 | Ragnarsson | 320/101 |
| 2007/0128950 | A1 * | 6/2007 | Merget | 439/677 |
| 2010/0267268 | A1 * | 10/2010 | Hering et al. | 439/345 |
| 2011/0086551 | A1 * | 4/2011 | Novotney et al. | 439/620.21 |
| 2011/0250769 | A1 | 10/2011 | Wang et al. | |
| 2012/0129405 | A1 * | 5/2012 | Keshet et al. | 439/676 |

FOREIGN PATENT DOCUMENTS

| | | |
|---|---|---|
| GB | 345492 | 11/1930 |
| GB | 2415097 | 12/2005 |

OTHER PUBLICATIONS

IEC 60320-1 Appliance couplers for household and similar general purposes—Part 1: General requirements, International Standard—IEC, vol. 60320-1, No. Ed.2.1, Nov. 1, 2007, p. 115pp, XP009141157.

* cited by examiner

*Primary Examiner* — Gary F. Paumen
(74) *Attorney, Agent, or Firm* — Altis Law Group, Inc.

(57) ABSTRACT

A power adapter includes a body, and a socket received in the body. The socket defines a first hole, a second hole and a third hole, and includes a live pin, a neutral pin and a ground pin respectively secured in the first hole, the second hole and the third hole. The live pin, the neutral pin and the ground pin are located along a straight line, and the neutral pin is located between the live pin and the ground pin.

9 Claims, 6 Drawing Sheets

SOCKET AND POWER ADAPTER EMPLOYING SAME

BACKGROUND

1. Technical Field

The present disclosure generally relates to power adapters, and especially to a socket of a power adapter.

2. Description of Related Art

In general, a socket of a power adapter comprises a live pin, a neutral pin and a ground pin, which are respectively secured in three holes defined in the power adapter. The three holes are arranged in a shape of a triangle. Correspondingly, a plug matching the power socket is in also a shape of the triangle, and is called Mickey Mouse Head type plug. However, due to the triangle shape of the Mickey Mouse Head type plug, a height of the power adapter matching with the plug cannot be minimized, which does not meet a development trend of lightness, thinness, and smallness of electronic products.

Therefore, a need exists in the industry to overcome the described problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
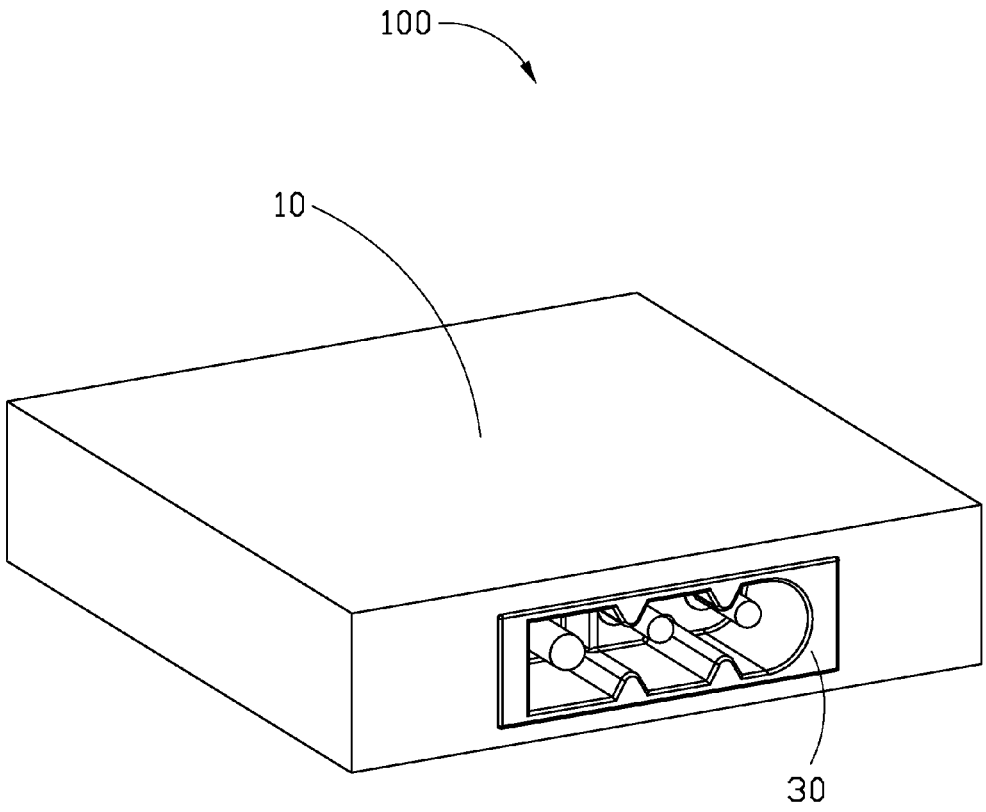
FIG. 1 is a perspective view of a power adapter of an exemplary embodiment of the disclosure.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

With reference to FIG. 1, a power adapter 100 comprises a body 10 and a socket 30 received in the body 10. A plug configured with a power plug can be inserted into the socket 30 of the power adapter 100 to connect the power adapter 100 with an external power source. The power adapter 100 supplies suitable power to an electronic device, such as a notebook, and powers the electronic device to work.

Figure 2:
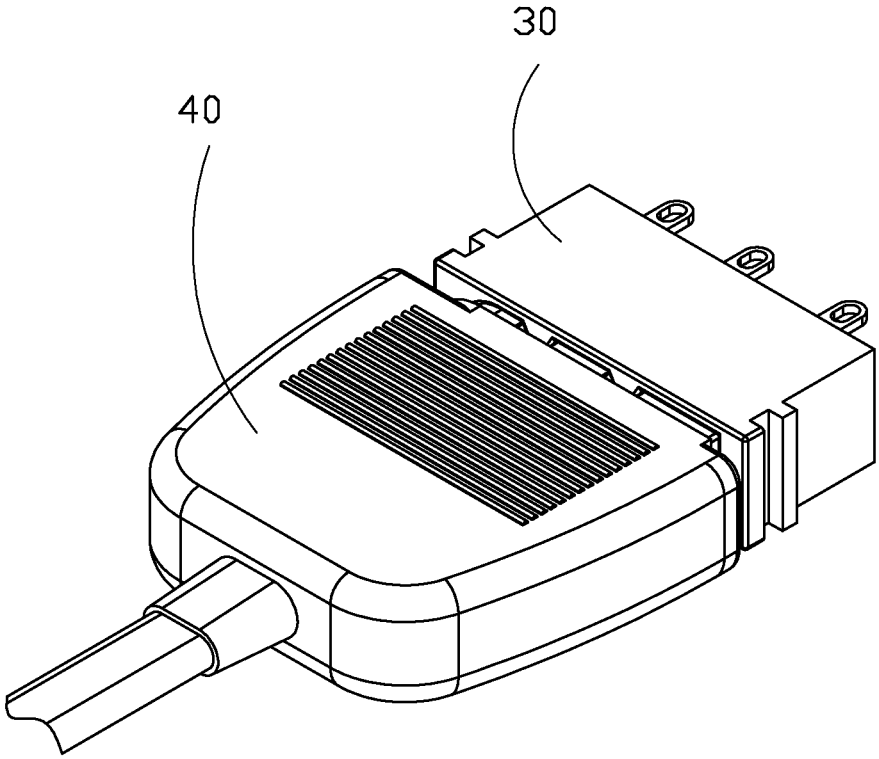
FIG. 2 is an assembled view of a socket of the power adapter of FIG. 1 and a first type power plug.
Figure 3:
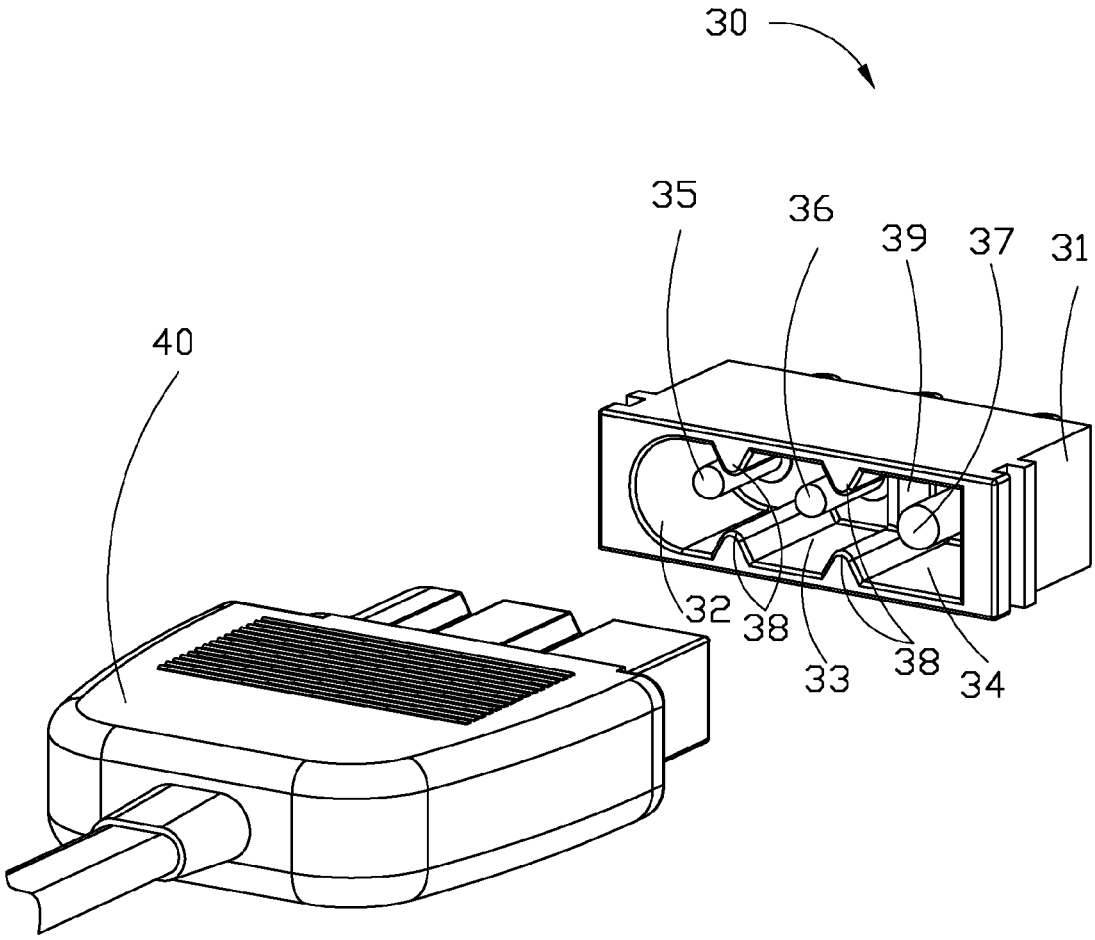
FIG. 3 is a disassembled view of FIG. 2.
Figure 4:
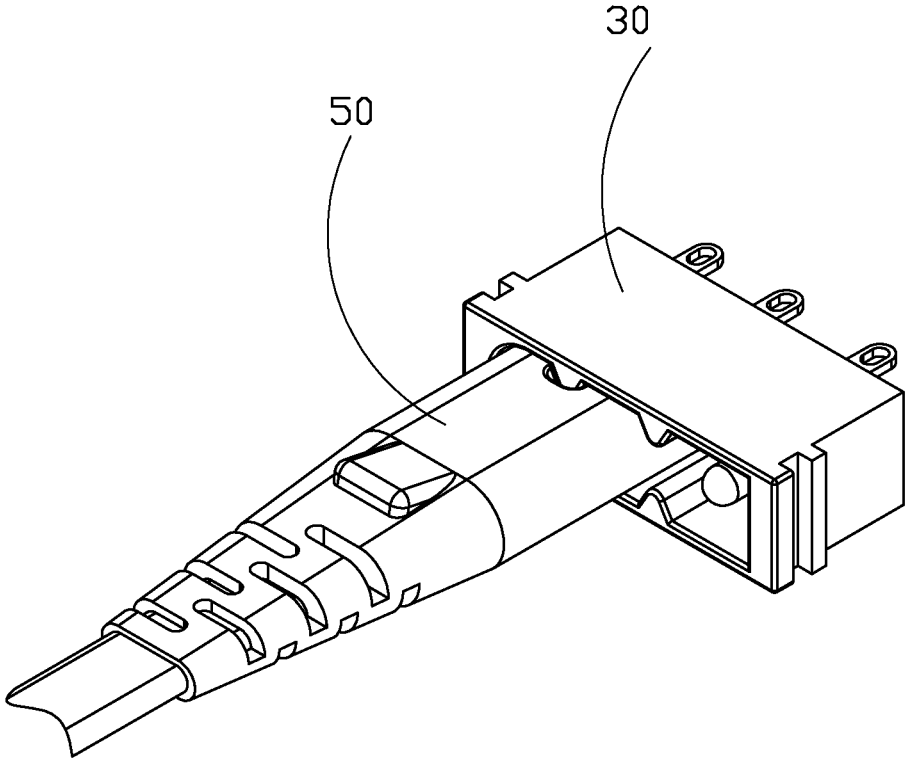
FIG. 4 is an assembled view of a socket of the power adapter of FIG. 1 and a second type power plug.
Figure 5:
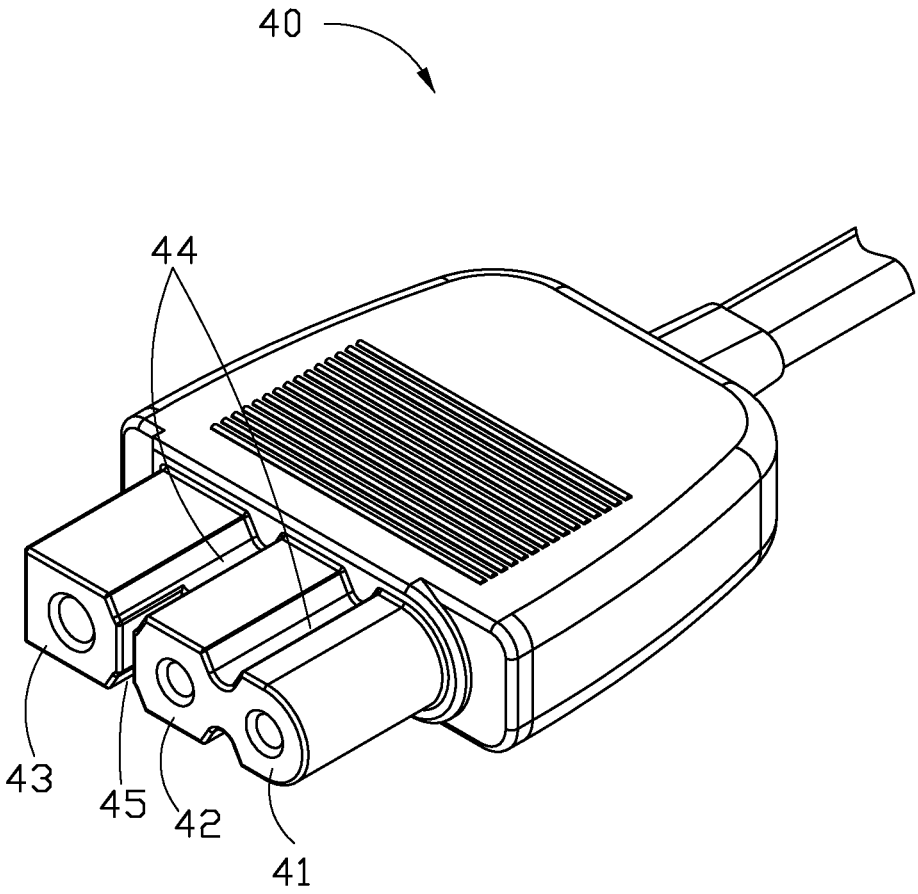
FIG. 5 is a perspective view of a terminal of the first type power plug of FIG. 2.
Figure 6:
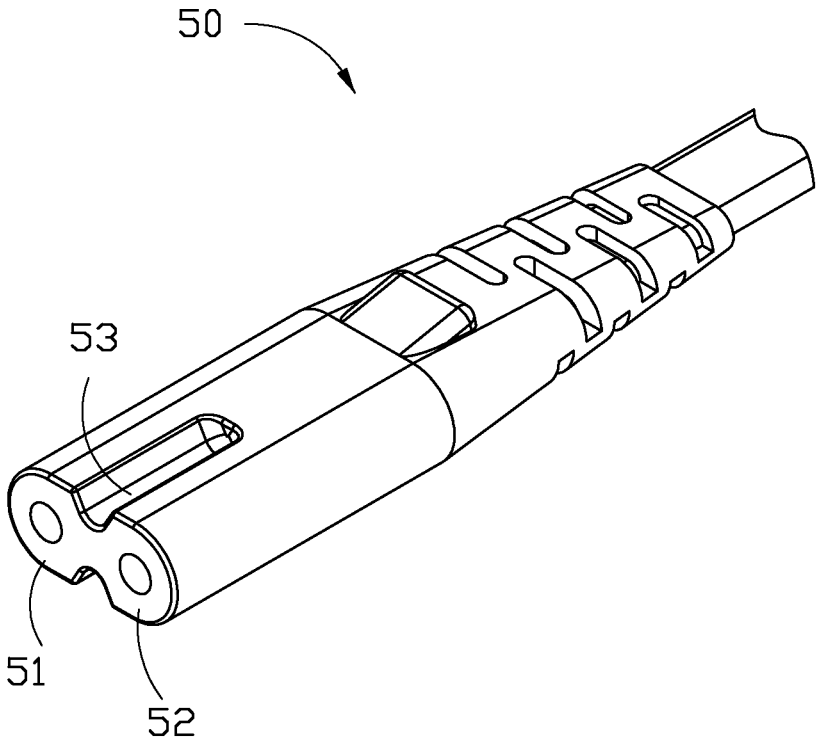
FIG. 6 is a perspective view of a terminal of the second type power plug of FIG. 4.

With reference to FIGS. 2-4, the socket 30 not only matches with a first type power plug 40, but also matches with a second type power plug 50. That is, the socket 30 can alternatively match with the first type power plug 40 and the second type power plug 50. In the embodiment, the first type power plug 40 is a three-phase power plug, as shown in FIG. 5. The second type power plug 50 is a single-phase power plug that does not include a ground terminal, as shown in FIG. 6. The single-phase power plug can be typical of power plugs for electronic devices today. With the socket 30, a customer would not worry about losing the first type power plug 40, because the second type power plug 50 instead of the three-phase power plug can be used, which is convenient and improves user experience.

The socket 30 comprises a housing 31 defining a first hole 32, a second hole 33 and a third hole 34 to receive and secure a live pin 35, a neutral pin 36 and a ground pin 37 respectively. The neutral pin 36 is located between the live pin 35 and the ground pin 37, and the live pin 35, the neutral pin 36 and the ground pin 37 are located along a straight line. With this structure, height of the power adapter 100 is effectively reduced.

In the embodiment, the first, second and third holes 32, 33, 34 communicate with each other. The socket 30 further comprises two pairs of opposite projections 38. One pair of opposite projections 38 are respectively located between the first hole 32 and the second hole 33, and the other pair of opposite projections 38 are respectively located between the third hole 34 and the second hole 33. Alternatively, the first, second and third holes 32, 33, 34 are separated from each other. That is, each pair of opposite projections 38 are connected together to separate the first, second and third holes 32, 33, 34 to be independent. In other embodiment, the projections 38 can be removed.

With reference to FIG. 5, the first type power plug 40 comprises a first terminal 41, a second terminal 42 and a third terminal 43. The first, second and third terminals 41, 42, 43 are correspondingly located along a straight line, and are respectively inserted into the first, second and third holes 32, 33, 34 of the socket 30. In the embodiment, a pair of opposite first slots 44 are defined between each two adjacent terminals of the first, second and third terminals 41, 42, 43 of the first type power plug 40. In assembly, the first, second and third terminals 41, 42, 43 of the first type power plug 40 are received in the first, second and third holes 32, 33, 34 of the socket 30, and are respectively connected with the live pin 32, the neutral pin 33 and the ground pin 34 of the socket 30. The two pairs of opposite projections 38 are respectively received in the first slots 44, which ensures the first type power plug 40 to connect with the socket 30 firmly.

Alternatively, when the first, second and third holes 32, 33, 34 of the socket 30 are separated from each other, the first, second and third terminals 41, 42, 43 of the first type power plug 40 are correspondingly independent from each other, and a gap is defined between each two adjacent terminals of the first, second and third terminals 41, 42, 43 of the first type power plug 40.

With reference to FIG. 5, the second type power plug 50 comprises a live terminal 51 and a neutral terminal 52, and defines a pair of opposite second slots 53 respectively located between the live terminal 51 and the neutral terminal 52. In assembly, the live terminal 51 and the neutral terminal 52 of the second type power plug 50 are respectively received in the first and second holes 32, 33 of the socket and connected with the live pin 35 and the neutral pin 36, and the projections 38 between the first hole 32 and the second hole 33 are respectively received in the pair of second slots 53.

In the embodiment, a shape of one of the first, second and third holes 32, 33, 34 of the socket 30 is different from that of another two of the first, second and third holes 32, 33, 34, which prevents the socket 30 and the first, second power plugs 40,50 from being wrongly inserted in one another. In the embodiment, the third hole 34 of the socket 30 is substantially in a shape of a square, and the first and second holes 32, 33 are substantially in a shape of an arc. Correspondingly, the third terminal 43 of the first type power plug 40 is substantially in a shape of a square, and the first and second terminals 41, 42 of the first type power plug 40 and the two terminals 51, 52 of the second type power plug 50 are substantially in a shape of an arc. Alternatively, the third hole 34 of the socket 30 can be substantially in a shape of an arc, and the first and second holes 32, 33 can be substantially in a shape of a square. The shapes of the three terminals 41, 42, 43 of the first type power plug 40 and the two terminals 51, 52 of the second type power plug 50 are changed correspondingly.

In the embodiment, the socket 30 comprises a separating board 39 located between the second hole 33 and the third hole 34. Correspondingly, the first type power plug 40 defines a groove 45 located between second terminal 42 and the third terminal 43. In assembly, the separating board 39 is received in the groove 45, which prevents the mistake insertion effectively.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A socket comprising a housing defining a first hole, a second hole and a third hole, and a live pin, a neutral pin and a ground pin respectively received and secured in the first hole, the second hole and the third hole, wherein the live pin, the neutral pin and the ground pin are located along a straight line, the neutral pin is located between the live pin and the ground pin, the third hole is in a shape of a square, and the first and second holes are in a shape of an arc.

2. The socket of claim 1, wherein the first, second and third holes are communicating with each other.

3. The socket of claim 2, further comprising two pairs of opposite projections, wherein one pair of opposite projections are located between the live pin and the neutral pin, and the other pair of opposite projections are located between the ground pin and the neutral pin.

4. The socket of claim 1, wherein a separating board is located between the neutral pin and the ground pin.

5. A power adapter comprising a body and a socket received in the body, the socket comprising a housing defining a first hole, a second hole and a third hole, and a live pin, a neutral pin and a ground pin respectively received and secured in the first hole, the second hole and the third hole, wherein the live pin, the neutral pin and the ground pin are located along a straight line, the neutral pin is located between the live pin and the ground pin, the third hole is in a shape of a square, and the first and second holes are in a shape of an arc.

6. The power adapter of claim 5, wherein the first, second and third holes are communicating with each other.

7. The power adapter of claim 6, further comprising two pairs of opposite projections, wherein one pair of opposite projections are located between the live pin and the neutral pin, and the other pair of opposite projections are located between the ground pin and the neutral pin.

8. The power adapter of claim 5, wherein a separating board is located between the neutral pin and the ground pin.

9. A power adapter comprising a socket and a plug, the socket defining a first hole, a second hole and a third hole on a straight line to receive a live pin, a neutral pin and a ground pin respectively, wherein the neutral pin is located between the live pin and the ground pin, the third hole is in a shape of a square, and the first and second holes are in a shape of an arc, the plug comprising either two terminals matching with the neutral pin and the live pin respectively or three terminals matching with the live pin, the neutral pin and the ground pin respectively.

* * * * *